US009815582B2

(12) United States Patent
Wojdyla et al.

(10) Patent No.: US 9,815,582 B2
(45) Date of Patent: Nov. 14, 2017

(54) METHOD TO PRINT AND APPLY LABELS TO PRODUCTS

(71) Applicant: Bell and Howell, LLC, Durham, NC (US)

(72) Inventors: Richard Wojdyla, Wadsworth, IL (US); Brian Bowers, Mundelein, IL (US); Tim Palmer, Lexington, NC (US); Tomasz K. Bednarek, Niles, IL (US)

(73) Assignee: Fluence Automation LLC, Wheeling, IL (US)

( * ) Notice: Subject to any disclaimer, the term of this patent is extended or adjusted under 35 U.S.C. 154(b) by 0 days.

(21) Appl. No.: 15/144,318

(22) Filed: May 2, 2016

(65) Prior Publication Data

US 2016/0251103 A1 Sep. 1, 2016

Related U.S. Application Data

(62) Division of application No. 14/043,259, filed on Oct. 1, 2013, now Pat. No. 9,352,872.

(51) Int. Cl.
*B65C 9/18* (2006.01)
*B65C 1/02* (2006.01)
(Continued)

(52) U.S. Cl.
CPC ..... *B65C 9/1884* (2013.01); *B65C 1/021* (2013.01); *B65C 9/02* (2013.01); *B65C 9/1803* (2013.01);
(Continued)

(58) Field of Classification Search
CPC ..... B65C 1/021; B65C 9/02; B65C 9/1826; B65C 9/1884; B65C 9/40;
(Continued)

(56) References Cited

U.S. PATENT DOCUMENTS 5,232,539 A 8/1993 Carpenter et al.
5,342,461 A 8/1994 Murphy
(Continued)

FOREIGN PATENT DOCUMENTS

EP 2 716 560 B1 7/2015
EP 3 012 203 A1 4/2016
(Continued)

OTHER PUBLICATIONS

European Search Report issued in European Patent Application No. 13 18 7382, dated Jan. 30, 2014.
(Continued)

*Primary Examiner* — George Koch
(74) *Attorney, Agent, or Firm* — Jenkins, Wilson, Taylor & Hunt, P.A.

(57) ABSTRACT

The present application relates to a method and system for labeling one or more products such as packages transported along a conveyer, and more specifically to applying a label on a respective package by way of a vertically adjustable assembly positioned above the conveyor. The adjustable assembly includes at least a label printer and an applicator for printing and applying the label on a surface of the package on the conveyor.

12 Claims, 14 Drawing Sheets

(51) Int. Cl.
*B65C 9/02* (2006.01)
*B65C 9/00* (2006.01)
*B65C 9/40* (2006.01)

(52) U.S. Cl.
CPC .... *B65C 9/1826* (2013.01); *B65C 2009/0081* (2013.01); *B65C 2009/401* (2013.01); *Y10T 156/1062* (2015.01)

(58) Field of Classification Search
CPC ..... B65C 2009/0081; B65C 2009/401; Y10T 156/1062
USPC ... 156/64, 351, 360, 362, 367, 378, DIG. 45
See application file for complete search history.

(56) References Cited

U.S. PATENT DOCUMENTS

| | | | | |
|---|---|---|---|---|
| 5,705,021 | A | 1/1998 | Wurz et al. | |
| 5,750,004 | A | 5/1998 | Wurz et al. | |
| 5,783,032 | A | 7/1998 | O'Callaghan et al. | |
| 5,922,169 | A | 7/1999 | Chodacki et al. | |
| 6,080,250 | A * | 6/2000 | Urban | B65C 9/1884 156/360 |
| 6,273,986 | B1 | 8/2001 | Egan | |
| 6,616,189 | B2 | 9/2003 | Raming | |
| 7,121,311 | B2 | 10/2006 | Vandersyde et al. | |
| 7,185,689 | B2 | 3/2007 | Jenkins et al. | |
| 7,437,860 | B2 | 10/2008 | Brandow et al. | |
| 7,632,367 | B2 | 12/2009 | Smith | |
| 7,900,675 | B2 | 3/2011 | Dangami | |
| 7,987,141 | B2 | 7/2011 | Lee | |
| 9,352,872 | B2 | 5/2016 | Wojdyla et al. | |
| 2004/0094253 | A1 | 5/2004 | Jenkins et al. | |
| 2004/0112520 | A1 | 6/2004 | Hanschen et al. | |
| 2005/0139323 | A1 * | 6/2005 | Syde | B26D 1/085 156/387 |
| 2006/0201348 | A1 | 9/2006 | Lee | |
| 2006/0231209 | A1 | 10/2006 | Smith | |
| 2007/0102109 | A1 | 5/2007 | Katritzky et al. | |
| 2007/0251189 | A1 | 11/2007 | Brandow et al. | |
| 2014/0096900 | A1 | 4/2014 | Wojdyla et al. | |
| 2016/0052659 | A1 | 2/2016 | Bowers et al. | |

FOREIGN PATENT DOCUMENTS

| | | | |
|---|---|---|---|
| FR | 2 719 283 | A1 | 11/1995 |
| GB | 2 076 549 | A | 12/1981 |
| JP | 2012 071 849 | A | 4/2012 |
| WO | WO 93/08081 | A1 | 4/1993 |
| WO | WO 93/23292 | A1 | 11/1993 |

OTHER PUBLICATIONS

Restriction Requirement for U.S. Appl. No. 14/043,259 dated Jul. 8, 2015.

SATO America at a Glance, from https://www.satoamerica.com/about-sato/sato-america-at-a-glance.aspx, site accessed on Sep. 29, 2015.

Non-Final Office Action for U.S. Appl. No. 14/043,259, dated Oct. 9, 2015.

Notice of Allowance for U.S. Appl. No. 14/043,259, dated Mar. 29, 2016.

European Search Report issued in European Patent Application No. 15190609.6, dated Mar. 18, 2016.

Notice of Publication for U.S. Appl. No. 15/190,609 dated Mar. 31, 2016.

Restriction Requirement for U.S. Appl. No. 14/886,549 dated Dec. 1, 2016.

Non-Final Office Action for U.S. Appl. No. 14/886,549 dated Mar. 9, 2017.

* cited by examiner

-- PRIOR ART --

METHOD TO PRINT AND APPLY LABELS TO PRODUCTS

CROSS-REFERENCE TO RELATED APPLICATIONS

This application is a divisional of and claims priority to U.S. patent application Ser. No. 14/043,259, filed Oct. 1, 2013, now U.S. Pat. No. 9,352,872, which claims priority to U.S. Provisional Application No. 61/709,403, filed Oct. 4, 2012, the entire disclosures of which are incorporated by reference herein.

TECHNICAL FIELD

The subject matter presented herein relates to a method and system for labeling a product such as a package while moving on a conveyer, and more specifically using a vertical positioning assembly to position at least the label printer, and applicator, which is fed from a roll of labeling material. One or more of these combined assemblies may be used for a package labeling system.

BACKGROUND

Package labeling for warehouse and distribution applications, have a configuration where the printer and label applicator are in a fixed positioned over the conveyor line and the applicator pad travels (by servo, stepper, or pneumatic drive) down to the product to be labeled and then must return the full distance to the fixed position of the print engine in order to receive the next label and repeat the process. These conventional features are illustrated in the FIG. 14. The labeler assembly consists of a roll of linered die cut labels 1, a label printer 2, a label peel blade 6 that removes the label from the liner and a liner take up roller 8 to accumulate the scrap liner material. This entire labeler assembly is mounted above the tallest package plus the conveyer, which makes it difficult to load the labels or service the assembly. The applicator pad 12 shown in the position to apply a label to the shortest package must return to the home position 4 to pick up the next label. Significant time is required to move the applicator the distance of the stroke 10, a distance dependent on application requirements, each time a package is labeled. The extra time to move the applicator results in a significant reduction in throughput. Hence a need exists for a labeling assembly that can be repositioned only when necessary and thereby utilizing less stroke distance for each label resulting in higher throughput.

SUMMARY

There is provided a method for labeling a plurality packages with a movable label applicator assembly. The assembly includes at least a printer and an applicator. The method comprises receiving data representing height and length of each of the packages transported along a conveyor. The conveyor speed is controlled based on a calculated pitch required between a first package and a trailing second package. Data is printed by way of the printer on a first label, and the first label is applied to the first package with the label applicator assembly positioned above the conveyor. A vertical height of the label applicator assembly is adjusted or maintained, based on any calculated height difference between the first package and the second package, at a sufficient height required for labeling of the second package. Data is printed with the printer on a second label intended for the second package. A supply of labeling material is fed or withdrawn into or from a vacuum system during the vertical height adjustment of the label applicator assembly. The second label is applied to the second package by way of the applicator.

There is also provided a label applicator system for labeling a plurality packages transported along a conveyor. The system includes at least one processor programmed for receiving data representing height and length of each of the packages transported along a conveyor; and controlling conveyor speed based on a calculated pitch required between a first package and a trailing second package. A movable label applicator assembly is positioned above the conveyor. The assembly includes a printer for printing data on a first label intended for the first package. An applicator applies the printed first label on a surface of the first package. A motor that is associated with the label applicator assembly vertically adjusts a height of the label applicator assembly above the conveyor. A label material drive unit feeds or withdraws a supply of labeling material into or from a vacuum system during vertical height adjustment of the label assembly over the conveyor.

The advantages and novel features are set forth in part in the description which follows, and in part will become apparent to those skilled in the art upon examination of the following and the accompanying drawings or may be learned by production or operation of the examples. The advantages of the present teachings may be realized and attained by practice or use of the methodologies, instrumentalities and combinations described herein.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
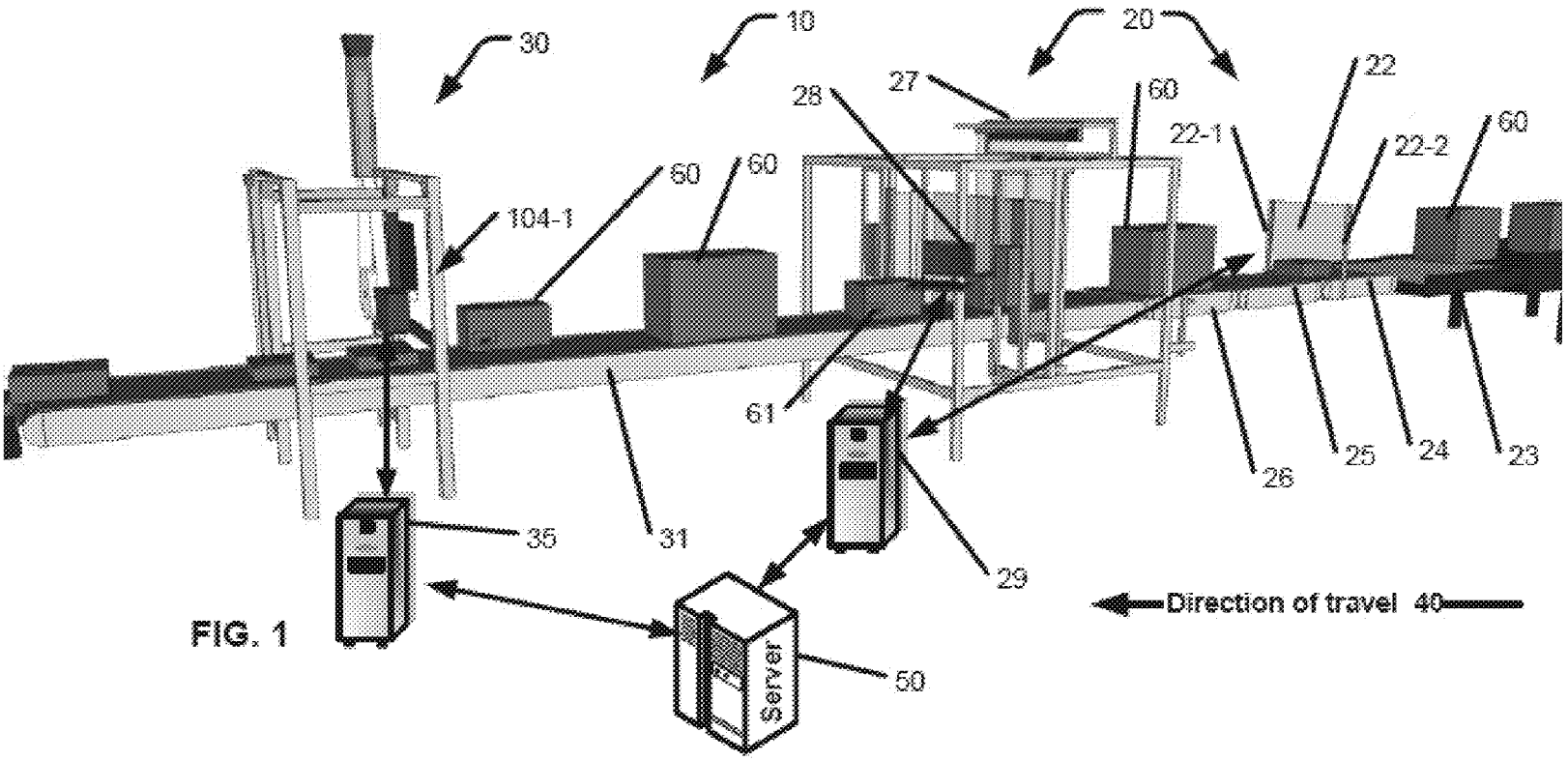
FIG. 1 illustrates a package labeling processing line including an exemplary package labeler.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

The teachings herein alleviate one or more of the above noted problems with design where throughputs can be increased dramatically due to the efficiency of the cyclic motion required for each label application. The high throughput is accomplished by combining the print and applicator design with controls that minimize the gap required between packages. The control system determines the minimum gap by measuring the length and height of each product. These values are used to calculate the time required to cycle through the print and apply sequence for the next package. Based on the operating line speed, the calculated time is converted into distance between a package's leading edge to the subsequent package's leading edge (pitch).

A labeling assembly is provided that can be repositioned only when necessary based on prior knowledge of the package height and therefore only requires a minimum distance stroke on the applicator. An example of a minimum distance stroke is about 6 inches. The linerless label material is mounted in a lower position separate from the labeler assembly to reduce weight and to facilitate a more ergonomic method of loading the label roll by an operator. The label material is linerless, therefore collection of the liner waste following the print and apply process is not required. The moveable labeler assembly contains a high speed printer and cutter that can generate variable label formats and sizes on demand thus enabling high throughput labeling without the need for additional labeling units.

The teachings herein alleviate one or more of the above noted conventional design problems where throughput can be increased dramatically due to the efficiency of the cyclic motion required for each label application. The high throughput is accomplished by combining the print and applicator design with controls that minimize the gap required between products. The controls utilized to determine the minimum gap measure the length and height of each product/package/carton. These values are used to calculate the time required to cycle through the print and application sequence for the next package. Based on the operating line speed, the calculated time is converted into distance between a package's leading edge to the subsequent package's leading edge (pitch). With the label supply positioned off-line it can be located in a more ergonomically suitable position which enables the use of a larger roll of labels. A larger roll of labels gives the added benefit of fewer label changes, thus less downtime.

Figure 12:
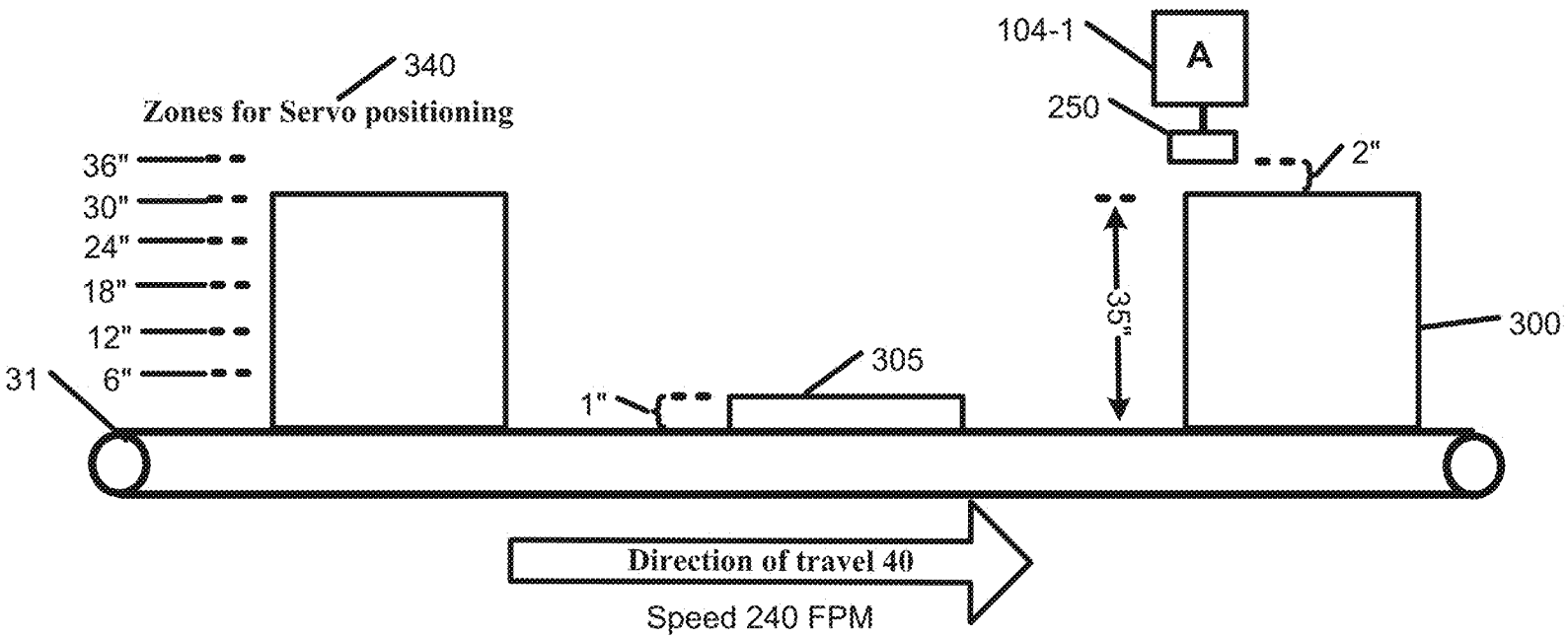
FIG. 12 design considerations for the Servo-Pneumatic Combo Labeler—worst case speed requirements.

Warehouse, consolidators and distribution markets are focused primarily in the receiving and shipping functions of the facility. These applications typically involve product flow that is random in size and weight opposed to batches of similar product found in applications in the manufacturing environment. Exemplary design considerations are discussed below. Reference is made to FIG. 12 for design considerations for a servo-pneumatic combination labeler—worst case—speed requirements; and FIG. 13 for design considerations for a servo-pneumatic combination labeler—worst case gap requirements.

A pneumatic system cycles at approximately 30"/sec compared to 55"/sec obtained by a servo driven system, but costs much less. A servo driven system is preferred to achieve the maximum throughput possible for longer stroke applications, but a longer stroke pneumatic system can be used for less demanding applications.

Longer Servo Driven Stroke:

At 120"/sec (max speed—calculate approximately 55"/sec to allow for acceleration and deceleration) a servo driven system is required for high throughput applications. To allow for most applications uncovered to date, a 36" maximum stroke length is required although the system will be modified to handle greater height variations if needed.

Servo Driven Positioning with Pneumatic Stroke:

Traditional print & apply systems incorporate a stationary home position for the dynamic pad to receive the label to be applied. The label is then transported to the location desired to apply the label to the product surface. Factors that influence labeling throughput are the following:

Print Time (Label Size/Print Speed)
unique label information (data transmission rate)
Stroke Distance
Conveyor Speed
Package Length
Batch feed or random height Taking the factors above into consideration, in order to maximize throughput, the limiting factors must be uncovered. With the printer speed maximized along with optimum material handling, the only improvement to be made resides with the speed of label application. Again, viewing the conventional method of cycling from a fixed home position creates dependency on the speed of the technology used to apply each label. In addition to this speed, because the labeling pad must always return to the home position for every cycle, the greater the height variance the more time that is consumed in cycle time for shorter packages. With this in mind, it is desired to mobilize the print engine, with the applicator assembly, which will result in bringing the home position of the applicator pad closer to the applied surface which minimizes the cycle time. Since the unit will not change position between packages unless required, and then only what is needed, this configuration will operate most efficiently the more packages of common height are conveyed past the labeler. This solution further increases system efficiency by incorporating linerless label stock thus no liner waste to manage.

Engineering studies can determine the appropriate number of positions combined with appropriate pneumatic stoke length. Design considerations indicate utilizing either the existing 6" stroke coupled with 6 positions or a 10" stroke utilizing 4 positions. The design choice is dependent on acceleration/deceleration rates of the servo positioning system as compared to the rates of the pneumatic labeling portion.

FIG. 12 illustrates exemplary labeler design parameters for the fielded system. The vertical repositioning components include a servo (108-1 FIG. 2), a drive shaft 106-1 and a right and left linear actuator 110-1. This configuration can reposition the label printer-actuator assembly 104-1 at 150 IPS (inches per second). The effective speed is 120 IPS when acceleration and deceleration are considered. The pneumatic assembly 255 FIG. 8 moves the applicator 250 at 30 IPS.

Figure 6:
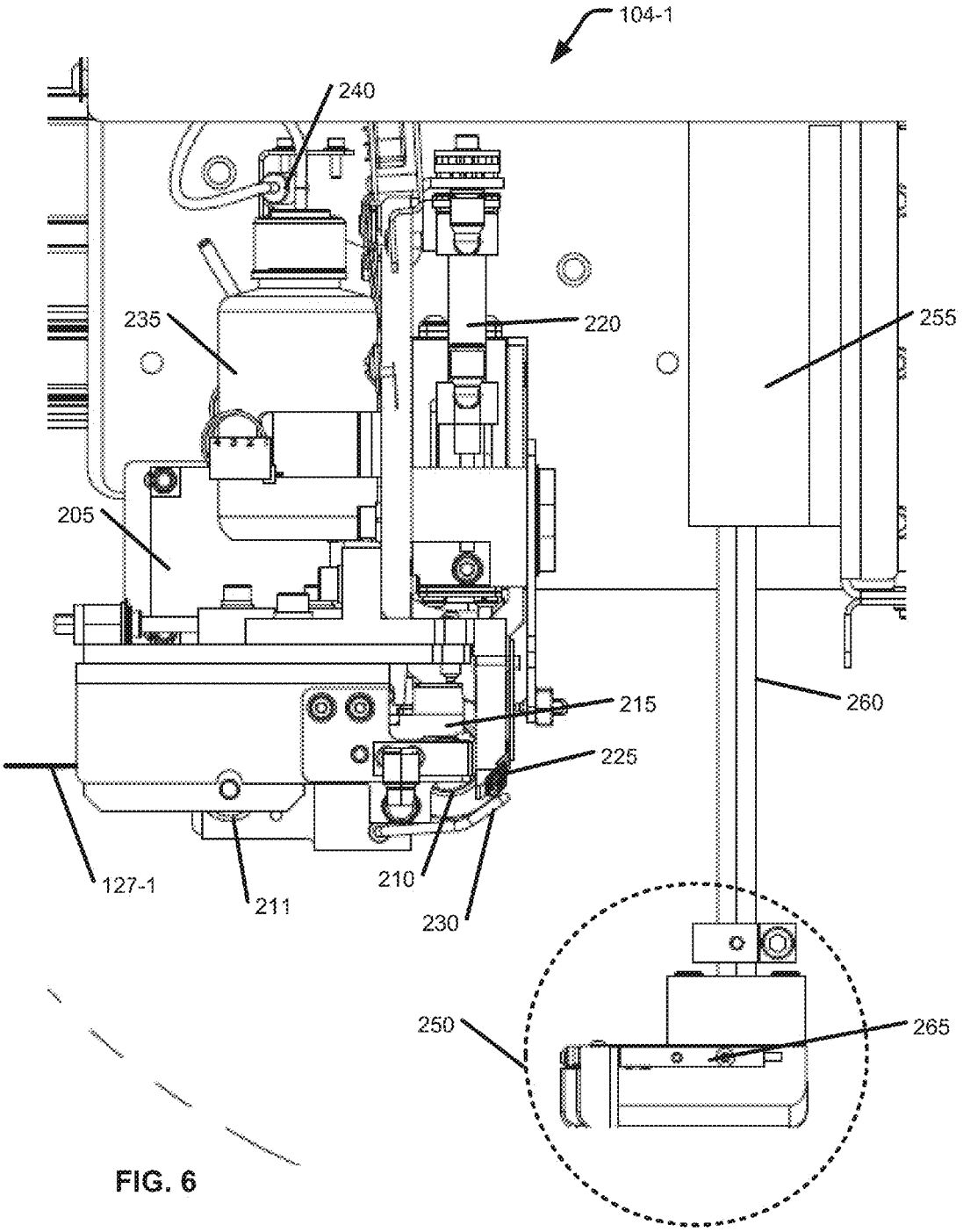
FIG. 6 is an exemplary drawing of the label printer-applicator assembly with the applicator in the down position.

The thermal printer 215 FIG. 6) prints label material at 12 IPS. The time to print a variable length label (1 inch to 6 inches) is a factor for overall throughput of the system. The vertical position of the label printer-applicator assembly 104-1 is divided into multiple zones 340. The applicator 250, with its 6 inch stroke, fills in for the spacing of the zones. The worst case example design parameters are based on the performance needed to label a 35" package 300 moving at 240 FPM (40) on the conveyor 31, where the label printer-applicator assembly 104-1A is positioned 2" above the package 300, and is ready to label a 1" package 305 without having to adjust the conveyor 31 speed or product pitch. Exemplary design parameters for the servo and pneumatic combination are:

$$\textit{Servo}\text{: SEC}/120'' * 30''(\text{max movement}) = 0.25 \text{ sec}$$

$$\text{Pneumatic: } \frac{\text{SEC}}{30''} \times 6''(\text{max stroke}) = 0.2 \text{ SEC}$$

$$\text{Print: } \frac{\text{SEC}}{12''} \times 3''(\text{label length}) = 0.25 \text{ SEC}$$

Figure 13:
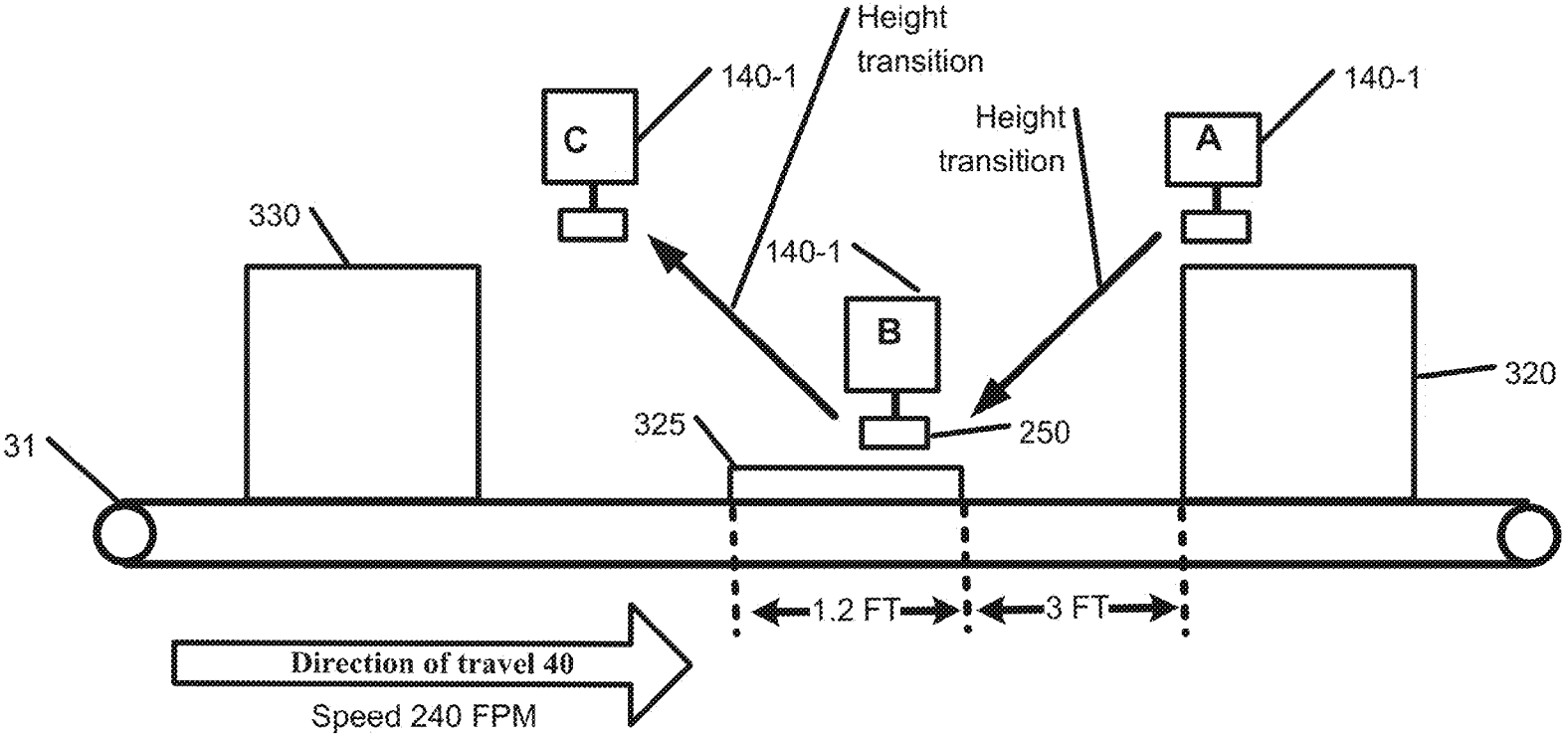
FIG. 13 design considerations for the Servo-Pneumatic Combo Labeler—worst case gap requirements.
Figure 14:
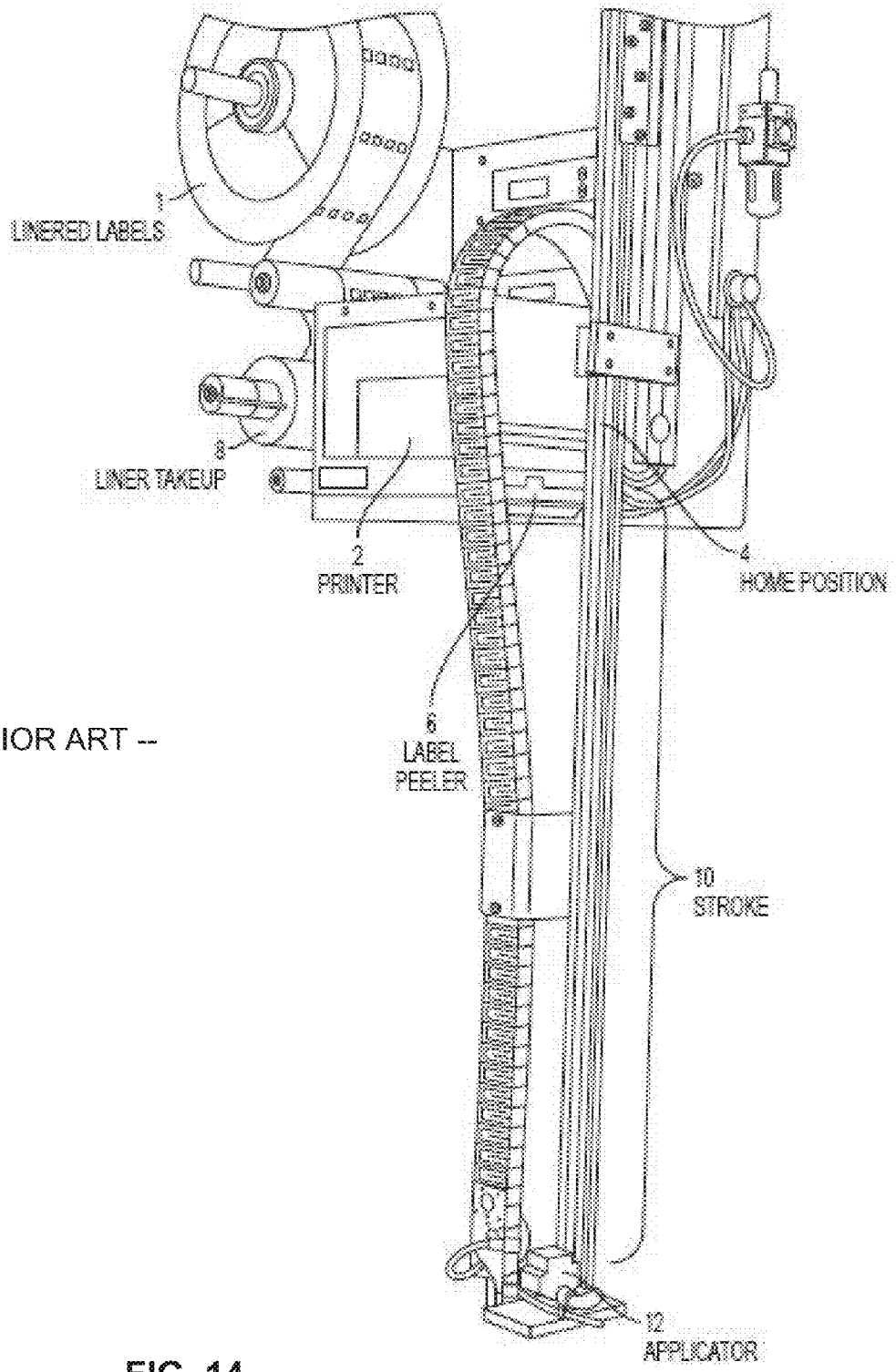
FIG. 14 illustrates a conventional package labeler.

Turning now to FIG. 13, for exemplary pitch (gap) design parameters. FIG. 13 shows three packages 320, 325 and 330 on a conveyor 31 moving at a speed of 240 FPM, left to right 40. These packages will move under a single label printer-actuator assembly 104-1 that is positioned at the correct height for label application. The vertical position of the label printer-actuator assembly 104-1 is illustrated in three progressive positions A, B and C. The label printer-actuator assembly 104-1 does not move from right to left as might be incorrectly assumed from illustration of the three vertical positions shown in a single figure. The gap required between the tallest package 320 followed by the shortest package 320 is as follows:

$$\frac{240 \text{ ft}}{\text{min}} \times \frac{1 \text{ mm}}{60 \text{ sec}} \times 0.7 \text{ sec} = 2.8 \text{ ft} + (0.2 \text{ ft} *) = 3 \text{ ft}$$

(* - for additional clearance before down stroke)

An additional foot is added to the gap since the package 325 will travel 1 foot before the label can be applied. This makes the total gap 4 feet. In practice, a 35" package will never be too short to not allow label print time while the prior package 320 clears the label printer-applicator assembly 140-1 (A position). Therefore the following required gap equation applies:

$$\frac{240 \text{ ft}}{\text{min}} \times \frac{1 \text{ mm}}{60 \text{ sec}} \times 0.45 \text{ sec} = 1.8 \text{ ft} + 0.2 \text{ ft} *= 2 \text{ ft} + 1 \text{ ft} = 3 \text{ ft}$$

The distance required to move the label printer-applicator assembly 104-1 (B position) to the label printer-applicator assembly 104-1 (C position), assuming the label printer-applicator assembly 104-1 moves upward prior to the pneumatic applicator 250 returning to home, is illustrated in the following equation:

$$\frac{240 \text{ ft}}{\text{min}} \times \frac{1 \text{ mm}}{60 \text{ sec}} \times 0.25 \text{ sec} = 1 \text{ ft} + 0.2 \text{ ft} *= 1.2 \text{ ft}$$

Therefore, the minimum distance required to label a package 325 between two 35 inch packages 320, 330 is 4.2 feet+the width of the package.

Reference now is made in detail to the examples illustrated in the accompanying drawings and discussed below. FIG. 1 illustrates the package labeling processing line 10 for warehouse, consolidator or distribution center. The packages 60 to be labeled enter the system from the right on a conveyer system 23 and travel to the left, as indicated by the directional arrow 40. The directional arrow 40 is provided as a common frame of reference from figure to figure. However, the label application system 30 is designed to operate in a bidirectional manner with one or more label printer-applicator assemblies 104-1. For example, a single label application system 30 can for used to apply stocking location labels on packages going to the warehouse and shipping labels to packages being routed from the warehouse to the shipping dock. The packages 60 are transferred from the shipping dock or the warehouse through the package measurement and label reader system 20. The package measurement subsystem 22 uses a series of photo detectors distributed along the sides 22-1, 22-2 to measure the height. The length of the package 60 is measured by the length of time a height measurement is registering and the speed of conveyers 24 and 25. Package height is used for accurate placement of the label on the top of the package. This height and length is processed by the package measurement and label reader system computer 29 and transferred either through the server 50 or directly to the labeler control computer 35. One or more operator interfaces 28 are provided for setup and job control. The height and length data for each package is processed by the labeler computer 35 to determine the pitch between packages that is needed for maximum throughput based on the vertical position of label printer-applicator assembly 104-1 within the label application system 30.

The pitch-labeler control computer algorithm is executed to determine the required package pitch by projecting the required vertical position of the label printer-applicator (FIG. 2 reference numerals 104-1, 104-2), within each label application subsystem 100-1 and 100-2, when the package that was just measured by the package measurement subsystem 22 arrives at the label application subsystem 100-1, 100-2. The required vertical height is dictated by the height of the package and the vertical distance that the label printer-applicator assembly must move to apply a label or clear the next package. The time of arrival of a given package at the label application system 30 is calculated by knowing the speed of conveyer 31 and the distance to be traveled. Sensors maybe added along the conveyer path to update tracking accuracy and to confirm arrival of the package at the label application system 30 and the arrival at the specific label printer-applicator assembly 104-1, 104-2 assigned to apply the label. The package pitch is minimized and the vertical motion of the label printer-applicator assembly 104-1, 104-2 is minimized to maximize throughput.

The pitch between packages is controlled by adjusting the speed of conveyers 25 and 26 or by use of metering belts which stop and start in order to provide the correct gap. Although three conveyers are illustrated, other configurations with more or less conveyors are contemplated. After the package height and length is measured, the package is transferred to conveyer 31, which moves at a constant speed, and transports the package through the induction barcode 61 reader 27. The induction barcode (license plate) 61, already attached to the package, contains or references data that defines the contents of and destination for the package in barcode or alpha-numeric format. This data is used to determine the information to be printed by the package labeler system disclosed herein. This data look up could be performed in a local database or interface to a host system. There are numerous applications for the warehouse and distribution center package labeling processing line 10 which include, but are not limited to:

Warehouse stocking
Distribution center—retail or wholesale
Order fulfillment
Hub sorting operations for delivery services The data on the preprinted label or data referenced by a barcode may include but is not limited to:

Package contents
Quantity
Warehouse destination
Retail or wholesale address
Customer address
Carrier—FEDEX, UPS, USPS The application will dictate the contents and format of the label to be printed and applied by the label application subassembly 100-1. The processor/computer 29, 35 and server 50 control and data distribution configuration illustrated in FIG. 1 maybe implemented in numerous ways depending on the design implemented by those skilled in the art.

Figure 2:
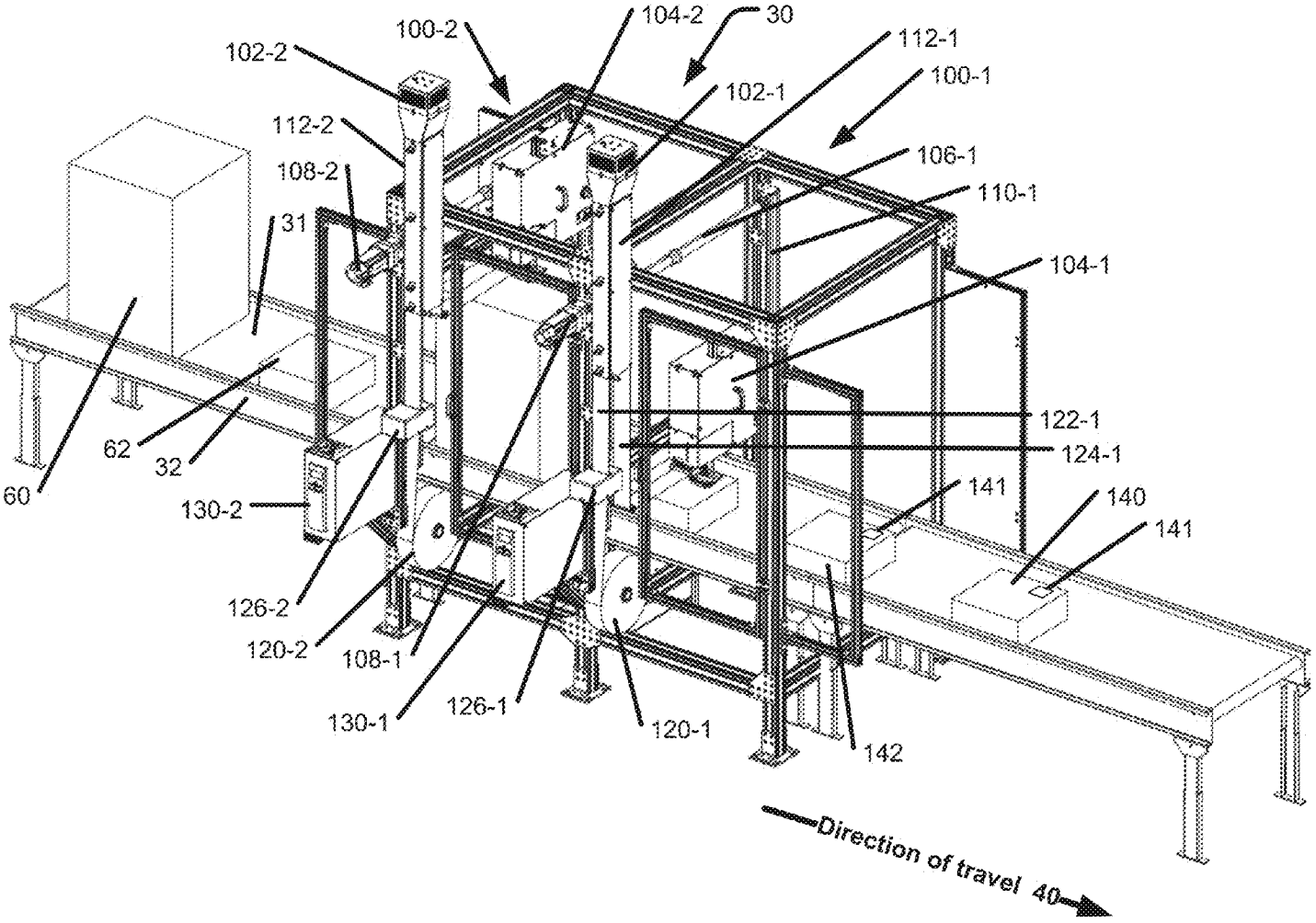
FIG. 2 is an exemplary illustration of a double label application system.

Reference is now made to FIG. 2 which illustrates an example of a double label application system 30. Packages 60, 62 enter the double label application system 30 from the left side on conveyer 31 and travel through the double label application system 30 and exit on the right, direction of travel 40. Packages 140 and 142 are shown with printed labels 141 attached. The illustrated example does not show an ability to move the label printer-cutter assembly 104-1 perpendicular to the direction of travel 40; therefore, the packages on conveyer 31 are justified against the side rail 32. However, an alternative solution adds a servo controlled horizontal positioning system for dynamically repositioning the label printer-applicator assembly 104-1 right or left on the package under computer control 35.

The double label application system 30 is comprised of two identical label application subassemblies 100-1 and 100-2. To avoid repetitive descriptions, like parts are labeled -1 for the first label application assembly 100-1 and -2 for the second label application assembly 100-2.

Figure 3:
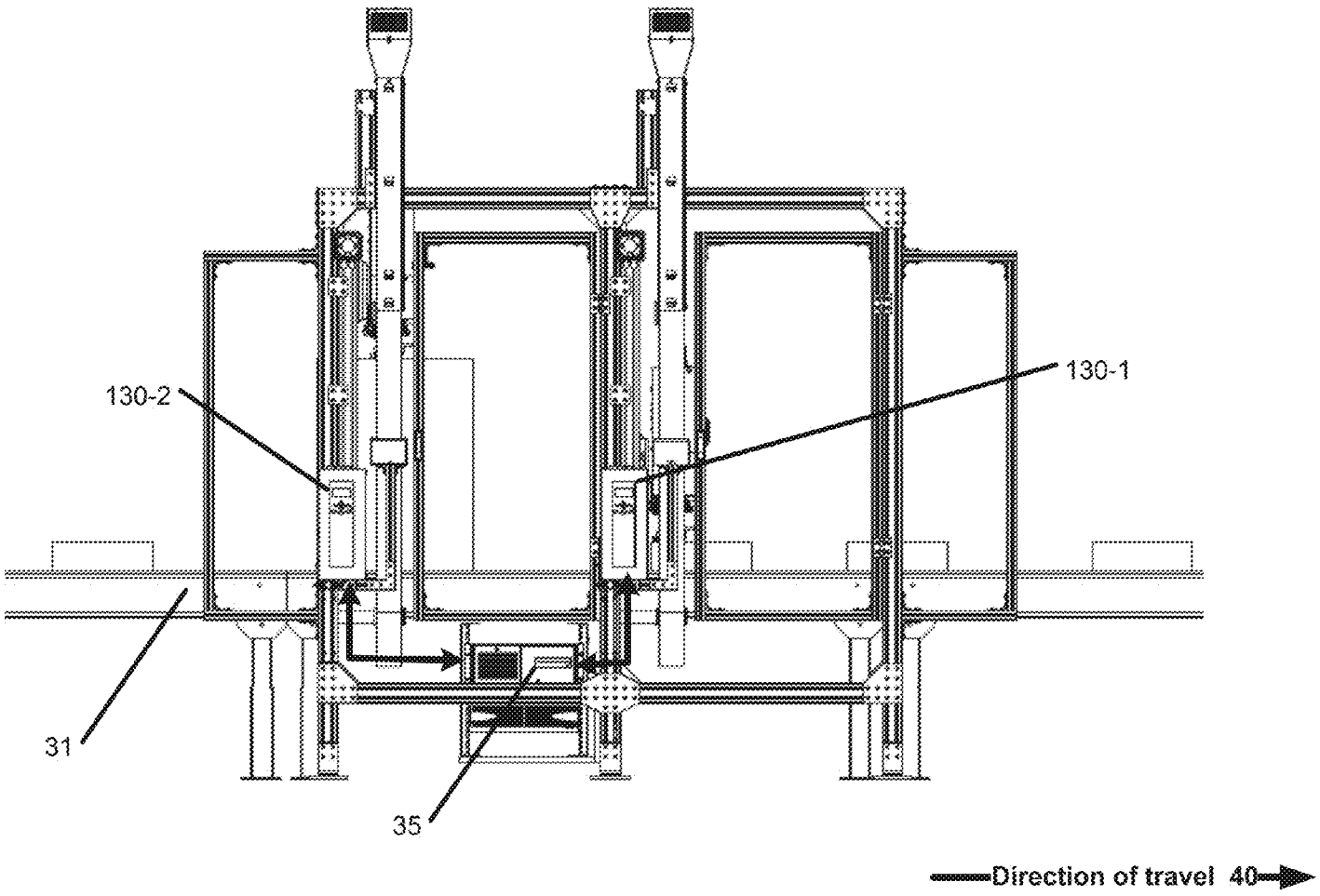
FIG. 3 illustrates the location of the labeler control computer.

Each label application assembly is controlled by a control box 130-1, 130-2 which includes operator controls on the top which are used for setup. The control box 130-1, 130-2 contains the servo and pneumatic controllers as well as sensor inputs. Label print data, package height data and label placement information comes from the labeler control computer 35. The labeler control computer 35 also synchronizes the operation of each of the double label application subsystems 100-1 and 100-2 to ensure that throughput is maximized and to ensure that the label printer-applicator assembly does not collide with a package. The labeler control computer 35 (FIG. 3) is mounted below the conveyer 31 and is in communication with both control boxes 130-1 and 130-2.

Figure 4A:
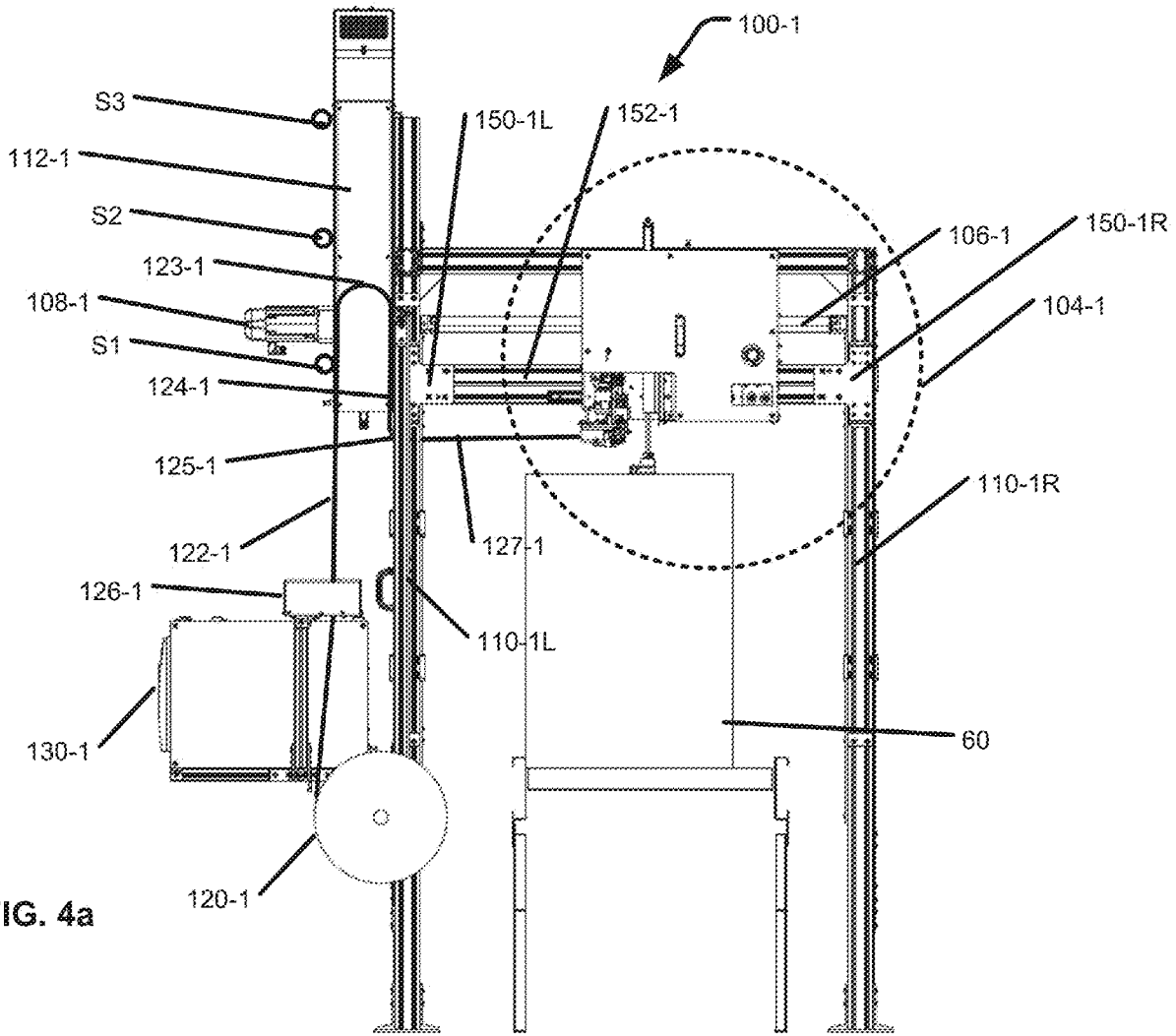
FIG. 4*a* is an exemplary drawing of the package linerless labeling system—with a tall package configuration.
Figure 7:
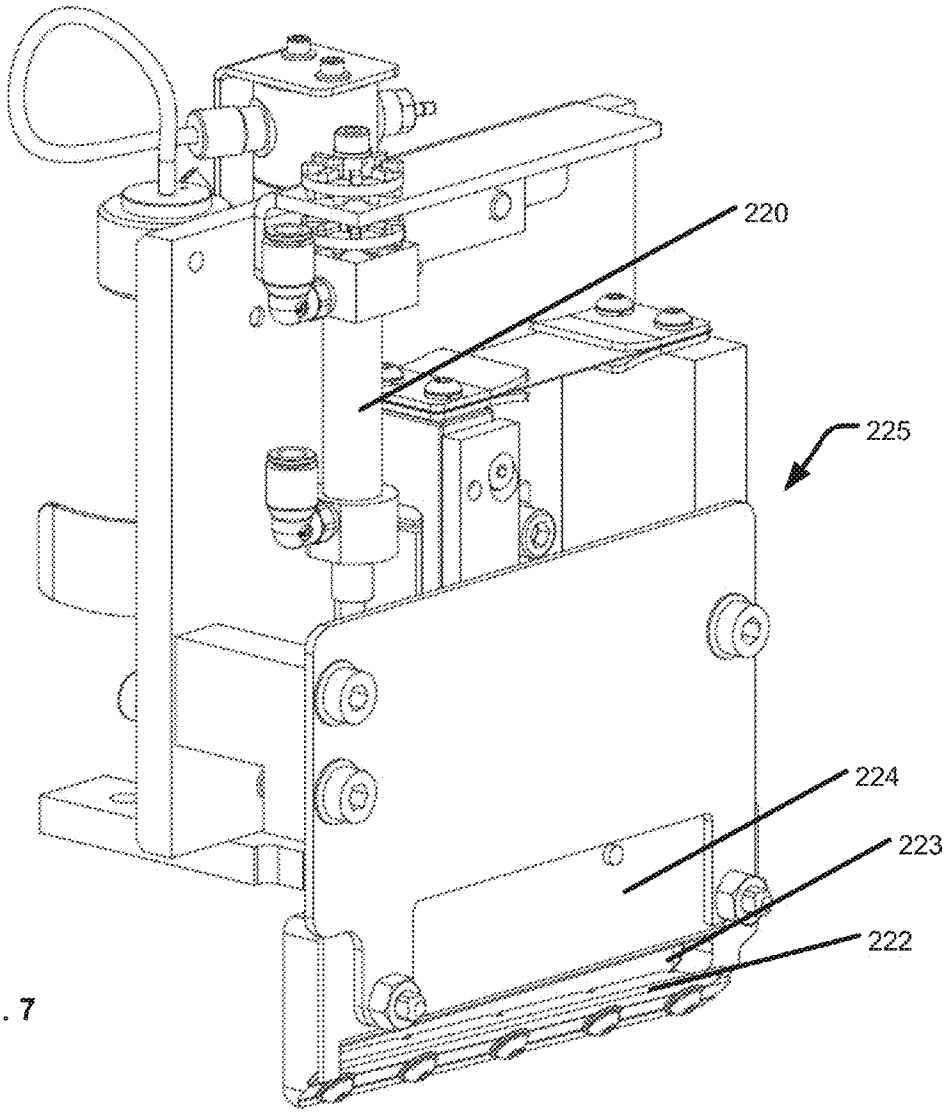
FIG. 7 is an exemplary drawing of the label material cutter.
Figure 8:
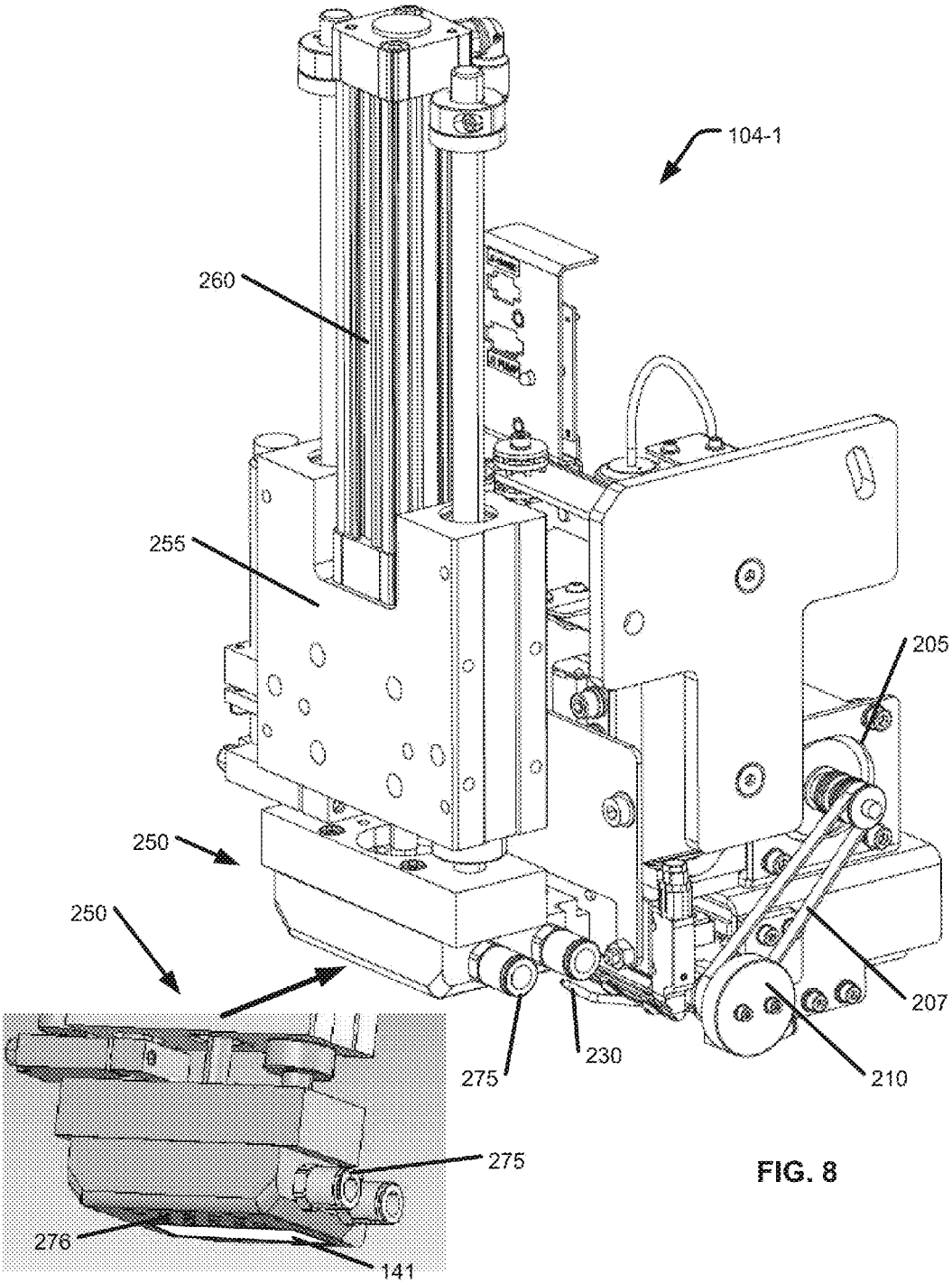
FIG. 8 is an isometric view from the back side of the label printer-applicator assembly with the applicator in the up position.

Each label application assembly 100-1, 100-2 contains a label printer-applicator assembly 104-1, 104-2, details of which are explained in FIGS. 6, 7 and 8. Reference is made to FIG. 4*a* to explain operation of the control boxes 130-1 and 130-2 during operation. Linerless label material is pulled from a supply roll 120-1, 120-2 by the label material drive systems 126-1 and 126-2. The speed at which the linerless label material is pulled from the roll 120-1, 120-2 is dependant on label usage, the position of the linerless label material in the vacuum tower 112-1, 112-2 and whether the label printer-applicator assembly 104-1, 104-2 is being repositioned up or down or is stationary. Linerless label material 122-1 is drawn into the vacuum tower 112-1, 112-2 by a vacuum fan 102-1, 102-2. The linerless label material 122-1 enters the vacuum tower 112-1, forms a loop in the vacuum tower and exits on the other side with the adhesive side of the linerless label material 124-1 facing in. The vertical position of each label printer-applicator assembly 104-1, 104-2 is controlled by the respective control box 130-1, 130-2 using the servo motors 108-1 and 108-2. The servo motors 108-1, 108-2 turns a drive shaft 106-1 which is connected to a toothed drive belt within the linear actuator 110-1 which in turn is connected to each label printer-applicator assembly 104-1, 104-2. The drive shall 106-1 drives a linear actuator on each side of the label printer-applicator assembly 104-1.

Reference is now made to FIG. 4*a* which is an end view of the first label application subsystem 100-1 which is illustrated in the top upper position and is required for labeling the tallest package 140. The label printer-applicator assembly 104-1 is positioned at the top location by the servo motor 108-1 rotating the drive shaft 106-1 which in turn rotates the toothed timing belt inside the right and left linear actuators 110-1R and 110-1L respectively. The label printer-applicator assembly 104-1 is attached to the support bar 152-1 with latches that can be released to manually reposition to the right or left depending on package labeling requirements. The support bar 152-1 is attached to the right and left linear actuators 110-1R, 110-1L by plates 150-1R and 150-1L. An alternative design adds an actuator to the support bar 152-1 to move the label printer-applicator assembly 104-1 right or left depending on the required label position. The automatic horizontal positioning removes the requirement to justify each package on the conveyer 31 to a side rail 32. In addition, the location of the label placement can dynamically be changed package to package.

Reference is now made to the linerless label material supply system illustrated in FIG. 4*a*. The label material is drawn from the supply roll 120-1 by the label material drive system 126-1 as needed by the label printer-applicator assembly 104-1 for the applied labels 141. The web of linerless label material 122-1 leaves the material drive system 126-1 and enters on the left side bottom of the vacuum tower 112-1. The control box runs the material drive system 126-1 so that the return loop of material 123-1 stays between sensors S1 and S2. Sensor S3 is a stop sensor to prevent the label material from jamming in the vacuum tower 112-1. The return web of material 124-1 exits the bottom of the vacuum tower 112-1, with the adhesive side facing in, and makes a right angle turn around roller 125-1 before the web of material 127-1 enters the label printer-applicator assembly 104-1.

Figure 4B:
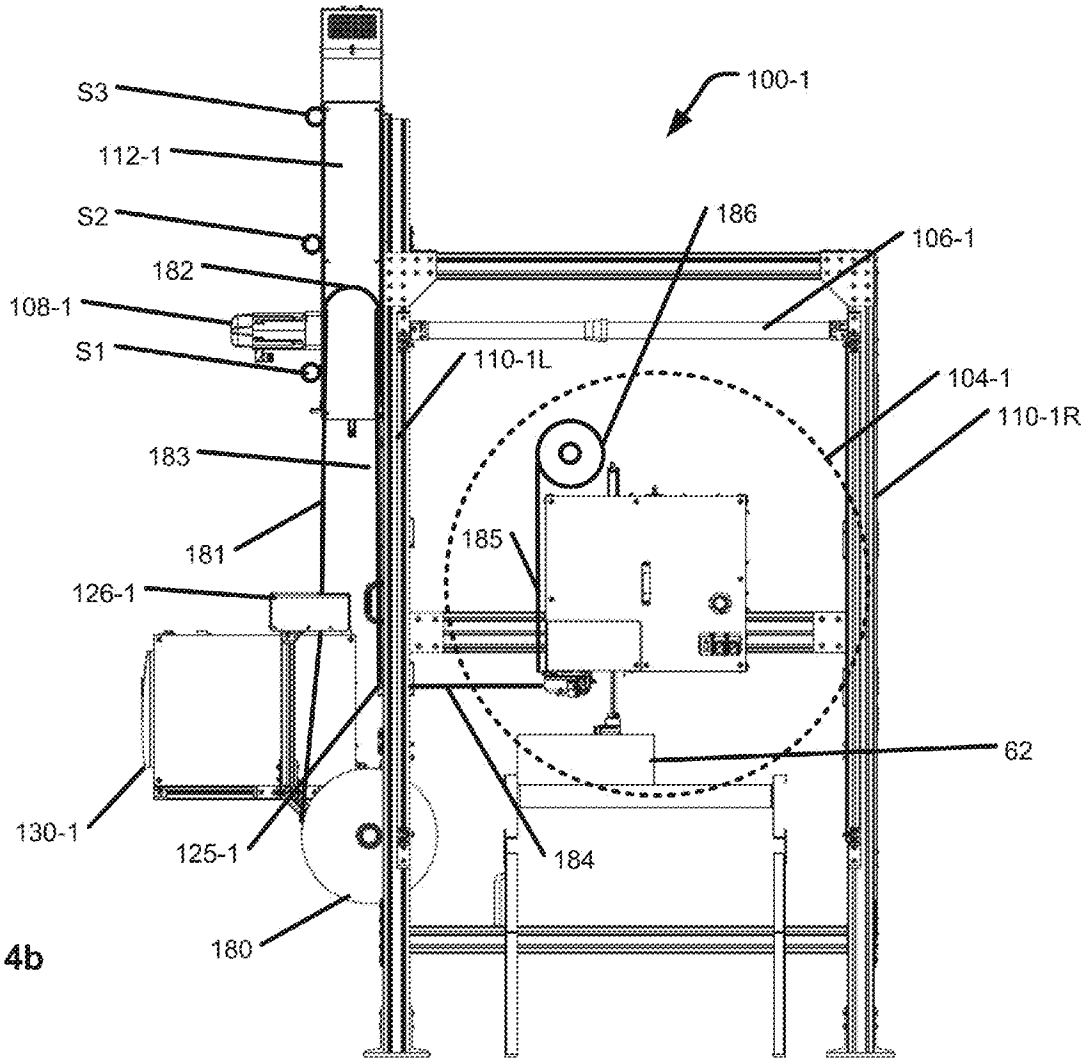
FIG. 4*b* is an exemplary drawing of the package linered labeling system—with a short package configuration.

There are two common types of rolled label stock in use for automatic labeling systems. Linerless label stock has a side for printing on and a side that is covered with an adhesive. The adhesive is not aggressive and can be peeled from the print side. This feature allows the label roll to be unrolled without damage. Linered label stock has a printing side and an adhesive side. The adhesive is more aggressive, which results in the need to have a nonstick backing applied to prevent damage to the material. The linered labels are die cut to a specific size and peeled off the backing by the label printer-applicator assembly 104-1 before they are applied to the package. Since the linered labels are all precut to a given size, it is not possible to have variable label size, label to label as can be done with a linerless label system. Reference is now made to FIG. 4*b* which is an end view of an alternate configuration of the label application subsystem 100-1 which uses linered label material as a replacement for linerless material. The label printer-applicator assembly 104-1 is illustrated in the bottom position as is required for labeling the shortest package 62. The label printer-applicator assembly 104-1 is positioned at the bottom location by the servo motor 108-1 rotating the drive shaft 106-1 which in turn rotates the toothed timing belt inside the right and left linear actuators 110-1R and 110-1L respectively. Reference is now made to the linered label material supply system illustrated in FIG. 4*b*. The label material is drawn from the supply roll 180 by the label material drive system 126-1 as needed by the label printer-applicator assembly 104-1 for the applied labels 141. The web of linered label material 181 leaves the material drive system 126-1 and enters on the left side bottom of the vacuum tower 112-1. The control box 130-1 runs the material drive system 126-1 so that the return loop of material 182 stays between sensors S1 and S2. Sensor S3 is a stop sensor to prevent the label material from jamming in the vacuum tower 112-1. The return web of material 183 exits the bottom of the vacuum tower 112-1, with the linered side facing in, and makes a right angle turn around roller 125-1 before the web of material 184 enters the label printer-applicator assembly 104-1. For the linered application, the label cutter assembly 225, FIG. 6, is replaced by a label stripper assembly. The thermal printer 215 and applicator air jets 230 remain. The liner material 185 is routed to a take up roller 186 to be collected and disposed of later.

Figure 5:
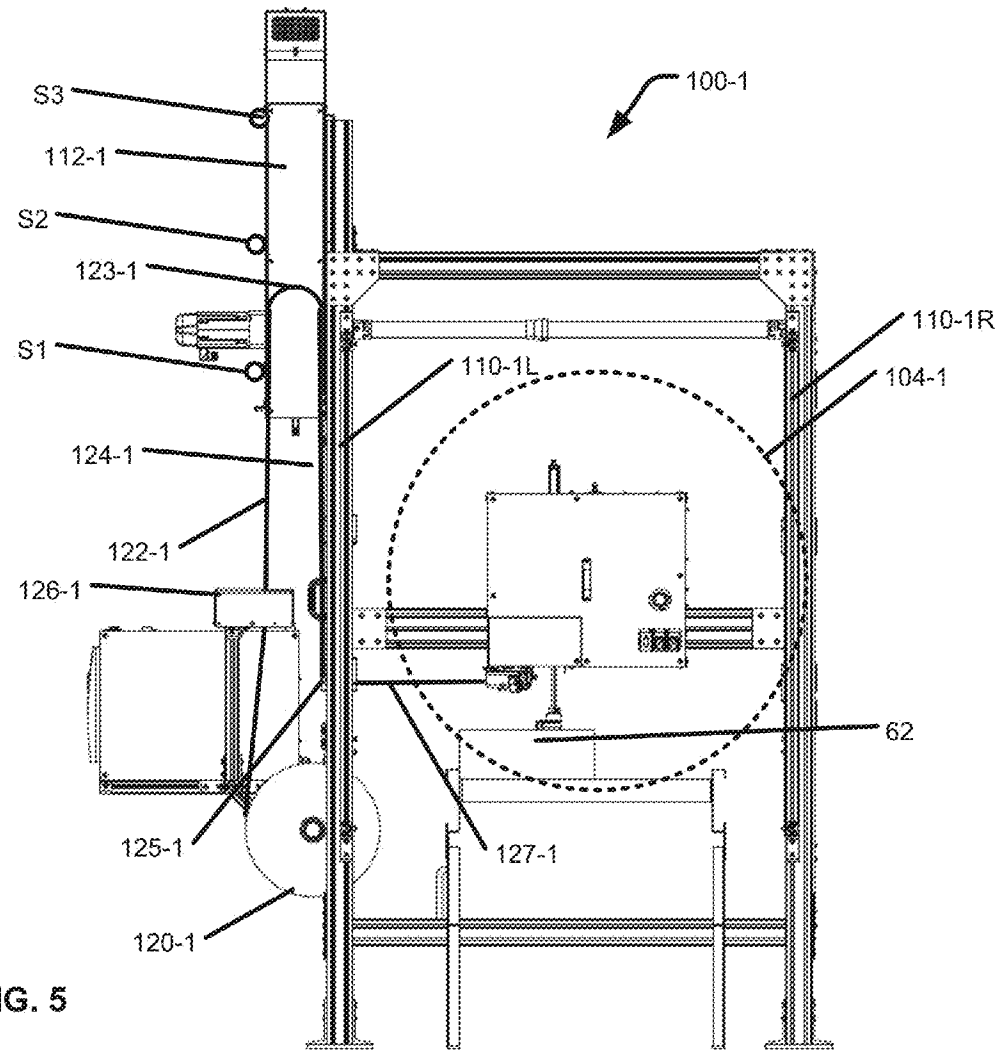
FIG. 5 is an exemplary drawing of the package labeling system—with a short package configuration.

FIG. 5 is an illustration of the label application system 100-1 positioned to label the smallest package 62. While the label printer-applicator assembly 104-1 is lowered by the linear actuators 110-1R and 110-1L from the top position, shown in FIG. 4*a*, to the bottom position, the material drive system 126-1 supplies linerless label material 122-1 at a rate of about 32 inches in about 0.6 seconds. The stroke length and speed maybe modified as required for different applications. The actual material speed fluctuates to maintain the return loop 123-1 between sensors S1 and S2 during the transition from top to bottom. The return web 124-1 moves at a constant speed as dictated by the motion of the linear actuators 110-1R and 110-1L. The return web 124-1 wraps around roller 125-1, which is connected to the linear actuator 110-1L, and the web continues in a horizontal position 127-1 into the label printer-applicator assembly 104-1. The return web 124-1 is pulled out of the vacuum tower 112-1 by the action of roller 125-1. Of course, the label printer-applicator assembly 104-1 can be positioned anywhere that is required to label a package from 1 inch to 36 inches high.

When the label printer-applicator assembly 104-1 is moved in the upward direction, the vacuum tower 112-1 accumulates the excess return web material 124-1 and the return loop 123-1 moves toward sensor S3. The vacuum tower 112-1 is sized to accommodate 32 inches of return web 124-1 without causing the return loop 113-1 to block sensor S3. No additional label material will be extracted from the label roll 120-1 until the return loop 123-1 drops below sensor S1.

Reference is now made to FIGS. 6, 7 and 8 for an explanation of the label printer-applicator assembly 104-1. U.S. Pat. No. 7,121,311 LINERLESS LABEL APPLICATION ASSEMBLY; U.S. Pat. No. 5,783,032 LINERLESS LABEL APPLICATOR; U.S. Pat. No. 5,922,169 LINERELESS LABEL APPLYING SYSTEM are incorporated by reference in their entirety. Referencing FIG. 6 for a detailed explanation of the label printer-applicator assembly 104-1 and the applicator 250, shown in the down position of 6 inches (other distances can be used). The label material 127-1 enters the label printer-applicator assembly 104-1 from the left. The label material is pulled into the assembly 104-1 by a pressure roller 210, which is driven by motor 205. A plasma coated roller 211 is positioned in the input section to stabilize the web of label material. The plasma coating is required to prevent the adhesive from adhering to the label material to the roller. As the label material 127-1 is pulled into the assembly 104-1, the thermal printer 215 prints the label contents and the label material advances through the label cutter assembly 225 and onto the applicator 250.

FIG. 8 shows the applicator in the home position where the applicator 250 can receive a label 141. The cutter 225 is actuated with a pneumatic cylinder 220. During the cutting operation, silicon oil is applied to the blade by a pump 240. The oil reservoir is contained in a bottle 235. The silicon oil prevents adhesive buildup on the cutter blades, which will lead to cutter failure. The applicator 250 is driven by the pneumatic assembly 255 which controls the motion of the connecting piston 260. Proximity or height measurement sensors 265 signal the control box 130 that the applicator 250 has nearly reached the package and the pneumatic controls must adjust the speed and the remaining amount of stroke so that the label is applied firmly enough to stick by utilizing a forced air blast and thus avoiding the applicator from coming in contact with the package. Those skilled in the art may use other than pneumatic actuators, such as but not limited to, electric solenoids.

FIG. 7 is an isometric drawing of the label cutter assembly 225. The label material is advanced through aperture 223, formed by the movable cutter blade 222 and the stationary blade 224, while the label content is being printed. When the printing is complete, the cutter blade 222 is actuated by the pneumatic cylinder 220. The cutting performance is enhanced by the angle between the cutter blade 222 and the stationary blade 224 which results in a scissor type cutting action.

FIG. 8 is an isometric view from the hack side of the label printer-applicator assembly 104-1 with the applicator 250 in the home position ready to receive completed labels. Since the applicator 250 is in the home position when the label printer-applicator assembly 104-1 is changing its vertical position, the label printing can occur simultaneously with the repositioning. The label material drive motor 205 is connected to the pressure roller 210 by a tooth timing belt 207 to prevent any slippage during printing that would distort or blur the content being printed. While the label is being printed, the label is held to the bottom of the applicator by air jets 230. When the label 141 printing is complete, a vacuum is applied though fittings 275 to the vacuum holes 276 in the bottom of the applicator 250. The vacuum is turned off and positive air pressure is applied to release the label 141 from the applicator 250 and to blow the label onto the package using the same vacuum holes 276. The label application occurs when the application stroke is completed as controlled using proximity or height measurement sensors 265 and the control box 130. The applicator 250 position is driven by the pneumatic assembly 255 which controls the motion by the connecting piston 260. The label 141 length is variable dynamically from about 1 inch to about 8 inches depending on format and content. U.S. Pat. No. 7,987,141—DYNAMICALLY CHANGING LABEL SIZE DURING MAIL PROCESSING is incorporated by reference in its entirety. As a result, each package can be labeled with different formats, such as but not limited, the carrier used for delivery, warehouse stocking requirements, delivery requirements—retail store, consumers home, other warehouses within the enterprise's network or to other wholesale outlets. Without the printing flexibility, separate jobs would have to be run. The width of the label is fixed by the width of the linerless label material roll, currently 4 inches. Those skilled in the art can make design adjustments to accommodate variations in label length and width.

Figure 9:
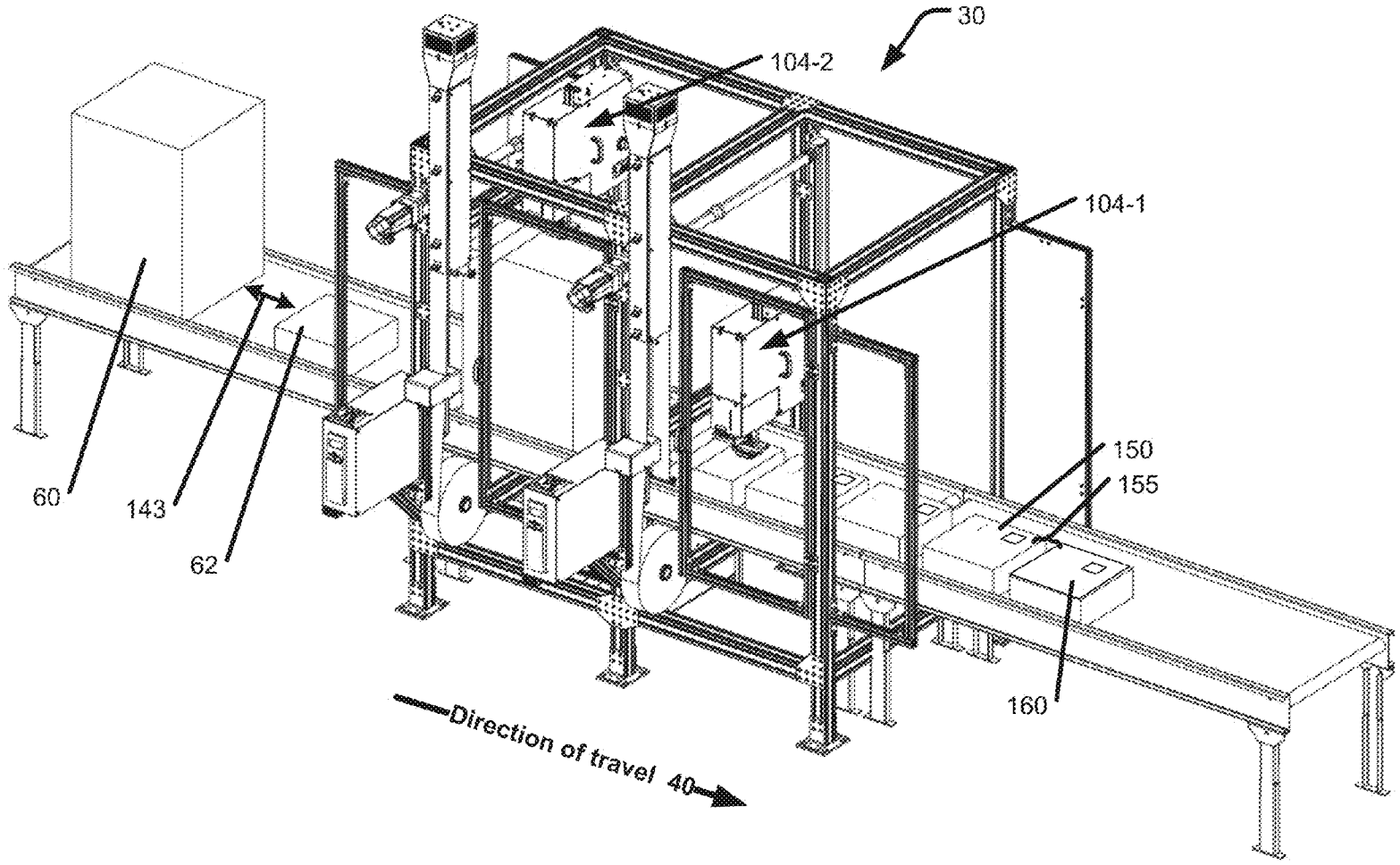
FIG. 9 is an illustration of the variable pitch between packages needed for enhanced throughput.

Reference is now made to FIG. 9 to illustrate the variable pitch between packages which enhances throughput. The pitch-labeler control computer algorithm has set the pitch 143 to the maximum to allow time for the label printer-applicator assembly 104-1 or 104-2 to be raised from the top of package 62 to correct position for labeling the large package 60. The pitch 155 between packages 150 and 160 was set to the minimum since neither of the label printer-applicator assemblies 104-1 or 104-2 were repositioned to label the series of small packages that are exiting the label application system 30. The direction of travel 40 of the packages is left to right. The label application system 30 is designed to operate in either direction of package conveyance. This means that the conveyer can move packages from the dock to the warehouse for stocking and back to the dock for distribution using the same label application system 30.

As shown by the above discussion, functions relating pertain to the operation of a warehouse and distribution center package labeling processing line wherein the labeling control is implemented in the hardware and controlled by one or more computers operating as the control computers 29, 35 connected to the label application system 30, the package measurement subsystem 22 and label reader subsystem 27 which in turn are connected to a data center processor/server 50 for data communication with the processing resources as shown in FIG. 1. Although special purpose devices may be used, such devices also may be implemented using one or more hardware platforms intended to represent a general class of data processing device commonly used to run "server" programming so as to implement the functions discussed above, albeit with an appropriate network connection for data communication.

As known in the data processing and communications arts, a general-purpose computer typically comprises a central processor or other processing device, an internal communication bus, various types of memory or storage media (RAM, ROM, EEPROM, cache memory, disk drives etc.) for code and data storage, and one or more network interface cards or ports for communication purposes. The software functionalities involve programming, including executable code as well as associated stored data. The software code is executable by the general-purpose computer that functions as the control processors 29, 35 and/or the associated terminal device 28. In operation, the code is stored within the general-purpose computer platform. At other times, however, the software may be stored at other locations and/or transported for loading into the appropriate general-purpose computer system. Execution of such code by a processor of the computer platform enables the platform to implement the methodology for controlling the warehouse and distribution center package labeling processing line, in essentially the manner performed in the implementations discussed and illustrated herein.

Figure 10:
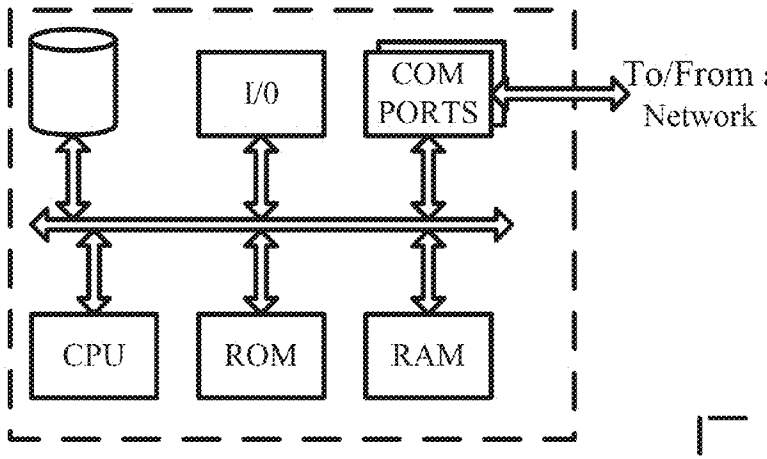
FIG. 10 illustrates a network or host computer platform, as may typically be used to implement a server.
Figure 11:
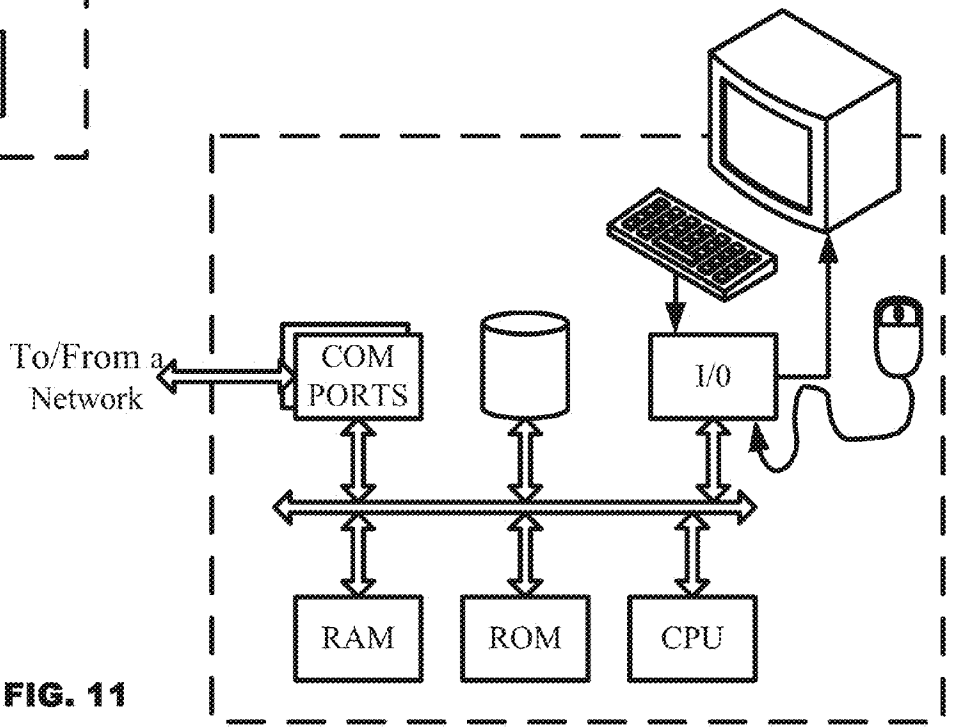
FIG. 11 depicts a computer with user interface elements, as may be used to implement a personal computer or other type of work station or terminal device.

FIGS. 10 and 11 provide functional block diagram illustrations of general purpose computer hardware platforms. FIG. 10 illustrates a network or host computer platform, as may typically be used to implement a server. FIG. 10 depicts a computer with user interface elements, as may be used to implement a personal computer or other type of work station or terminal device, although the computer of FIG. 10 may also act as a server if appropriately programmed. It is believed that those skilled in the art are familiar with the structure, programming and general operation of such computer equipment and, as a result, the drawings should be self-explanatory.

For example, control processors 29, 35 may be a PC based implementation of a central control processing system like that of FIG. 10, or may be implemented on a platform configured as a central or host computer or server like that of FIG. 11. Such a system typically contains a central processing unit (CPU), memories and an interconnect bus. The CPU may contain a single microprocessor (e.g. a Pentium microprocessor), or it may contain a plurality of microprocessors for configuring the CPU as a multi-processor system. The memories include a main memory, such as a dynamic random access memory (DRAM) and cache, as well as a read only memory, such as a PROM, an EPROM, a FLASH-EPROM or the like. The system memories also include one or more mass storage devices such as various disk drives, tape drives, etc.

In operation, the main memory stores at least portions of instructions for execution by the CPU and data for processing in accord with the executed instructions, for example, as uploaded from mass storage. The mass storage may include one or more magnetic disk or tape drives or optical disk drives, for storing data and instructions for use by CPU. For example, at least one mass storage system in the form of a disk drive or tape drive, stores the operating system and various application software. The mass storage within the computer system may also include one or more drives for various portable media, such as a floppy disk, a compact disc read only memory (CD-ROM), or an integrated circuit non-volatile memory adapter (i.e. PC-MCIA adapter) to input and output data and code to and from the computer system.

The system also includes one or more input/output interfaces for communications, shown by way of example as an interface for data communications with one or more other processing systems. Although not shown, one or more such interfaces may enable communications via a network, e.g., to enable sending and receiving instructions electronically. The physical communication links may be optical, wired, or wireless.

The computer system may further include appropriate input/output ports for interconnection with a display and a keyboard serving as the respective user interface for the processor/controller. For example, a printer control computer in a document factory may include a graphics subsystem to drive the output display. The output display, for example, may include a cathode ray tube (CRT) display, or a liquid crystal display (LCD) or other type of display device. The input control devices for such an implementation of the system would include the keyboard for inputting alphanumeric and other key information. The input control devices for the system may further include a cursor control device (not shown), such as a mouse, a touchpad, a trackball, stylus, or cursor direction keys. The links of the peripherals to the system may be wired connections or use wireless communications.

The computer system runs a variety of applications programs and stores data, enabling one or more interactions via the user interface provided, and/or over a network to implement the desired processing, in this case, including those for tracking of mail items through a postal authority network with reference to a specific mail target, as discussed above.

The components contained in the computer system are those typically found in general purpose computer systems. Although summarized in the discussion above mainly as a PC type implementation, those skilled in the art will recognize that the class of applicable computer systems also encompasses systems used as host computers, servers, workstations, network terminals, and the like. In fact, these components are intended to represent a broad category of such computer components that are well known in the art. The present examples are not limited to any one network or computing infrastructure model i.e., peer-to-peer, client server, distributed, etc.

Hence aspects of the techniques discussed herein encompass hardware and programmed equipment for controlling the relevant document processing as well as software programming, for controlling the relevant functions. A software or program product, which may be referred to as a "program article of manufacture" may take the form of code or executable instructions for causing a computer or other programmable equipment to perform the relevant data processing steps, where the code or instructions are carried by or otherwise embodied in a medium readable by a computer or other machine. Instructions or code for implementing such operations may be in the form of computer instruction in any form (e.g., source code, object code, interpreted code, etc.) stored in or carried by any readable medium.

Such a program article or product therefore takes the form of executable code and/or associated data that is carried on or embodied in a type of machine readable medium. "Storage" type media include any or all of the memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the relevant software from one computer or processor into another, for example, from a management server or host computer into the image processor and comparator. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer(s) or the like. Volatile storage media include dynamic memory, such as main memory of such a computer platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

In the detailed description above, numerous specific details are set forth by way of examples in order to provide a thorough understanding of the relevant teachings. However, it should be apparent to those skilled in the art that the present teachings may be practiced without such details. In other instances, well known methods, procedures, components, and software have been described at a relatively high-level, without detail, in order to avoid unnecessarily obscuring aspects of the present teachings.

The invention claimed is:

1. A method for labeling a plurality of packages with a movable label applicator assembly including at least a printer and an applicator, the method comprising steps of:

receiving data representing height and length of each of the packages transported along a conveyor;

controlling conveyor speed based on a calculated pitch required between a first package and a trailing second package;

printing data by way of the printer on a first label;

applying the first label to the first package with the label applicator assembly positioned above the conveyor;

cutting the printed first label from a supply of a continuous web of label material;

dynamically adjusting or maintaining a vertical height of the label applicator assembly, based on any calculated height difference between the first package and the trailing second package, at a sufficient height required for labeling of the trailing second package;

printing data, by way of the printer, on a second label intended for the trailing second package;

feeding or withdrawing a supply of the continuous web of label material into or from a vacuum system during the vertical height adjustment of the label applicator assembly; and applying the second label to the second package by way of the applicator;

wherein the applicator is pneumatically extendable to each of the packages; and wherein the supply of the continuous web of label material is mounted separate from the label applicator assembly and is configured to be applied by the applicator on surfaces of each of the packages after the vertical height of the label applicator assembly is dynamically adjusted to accommodate each of the packages.

2. The method of claim 1, wherein the adjusting step comprises:

elevating the height of the label applicator assembly, wherein the height of the trailing second package is greater than the height of the first package.

3. The method of claim 1, wherein the adjusting step comprises:

lowering the height of the label applicator assembly, wherein the height of the trailing second package is less than the height of the first package.

4. The method of claim 1, wherein the step of feeding or withdrawing the supply of the continuous web of label material comprises either:

feeding the supply of the continuous web of label material into the vacuum assembly as the label applicator assembly is adjusted lower and toward the conveyor; or withdrawing the supply of the continuous web of label material back into the vacuum assembly as the label applicator assembly is adjusted up and away from the conveyor.

5. The method of claim 1, wherein the step of applying the second label includes:

holding the printed second label against the applicator with a vacuum; and supplying an air burst to the applicator to release the printed second label from the applicator and applying the printed second label on the trailing second package.

6. The method of claim 5, wherein the label applicator assembly further comprises:

a proximity sensor that determines a distance between the applicator and an upper surface of the trailing second package prior to applying the printed second label on the trailing second package.

7. The method of claim 1, further comprising:

printing data on a third label intended for a third package by way of a second label applicator assembly including a second printer and a second applicator; and applying the third label to the third package with a second applicator of the second label applicator assembly;

wherein the third label is supplied from a second supply of a continuous web of label material.

8. The method of claim 1, further comprising the step of:

by way of a cutter, cutting the printed second label from the supply of the continuous web of label material prior to applying the printed second label to the trailing second package, wherein the supply of the continuous web of label material comprises a plurality of linerless labels.

9. The method of claim 1, further comprising:

by way of a stripper, stripping away a backing of the printed second label from the supply of the continuous web of label material prior to applying the printed second label to the trailing second package, wherein the supply of the continuous web of label material comprises a plurality of labels with backing.

10. The method of claim 1, further comprising the step of:

adjusting a horizontal position of the label applicator assembly relative to the trailing second package on the conveyor.

11. The method of claim 1, further comprising dynamically cutting subsequent individual labels of varying sizes depending on data printed on each respective label from the supply of the continuous web of label material.

12. The method of claim 1, further comprising positioning the supply of the continuous web of label material below the label applicator assembly and adjacent to the conveyor, wherein the supply of the continuous web of label material comprises linerless label material or linered label material.

* * * * *